US011161639B2

(12) United States Patent
Goodman et al.

(10) Patent No.: US 11,161,639 B2
(45) Date of Patent: Nov. 2, 2021

(54) BOX-DISPENSING APPARATUS, BOXES FOR USE IN THE BOX-DISPENSING APPARATUS, AND METHODS OF USING THE BOX-DISPENSING APPARATUS

(71) Applicant: Creator, Inc., San Francisco, CA (US)

(72) Inventors: Maxwell Goodman, Oakland, CA (US); Jaylyn Daugherty, San Francisco, CA (US); Noe Esparza, San Francisco, CA (US); Abigail Soong, San Francisco, CA (US)

(73) Assignee: Creator, Inc., San Francisco, CA (US)

( * ) Notice: Subject to any disclaimer, the term of this patent is extended or adjusted under 35 U.S.C. 154(b) by 0 days.

(21) Appl. No.: 17/254,777

(22) PCT Filed: Jun. 20, 2019

(86) PCT No.: PCT/US2019/038343

§ 371 (c)(1),
(2) Date: Dec. 21, 2020

(87) PCT Pub. No.: WO2019/246466

PCT Pub. Date: Dec. 26, 2019

(65) Prior Publication Data

US 2021/0269186 A1 Sep. 2, 2021

Related U.S. Application Data

(60) Provisional application No. 62/687,799, filed on Jun. 20, 2018.

(51) Int. Cl.
*B65B 43/44* (2006.01)
*B65B 43/18* (2006.01)
(Continued)

(52) U.S. Cl.
CPC ..... *B65B 43/44* (2013.01); *B65B 43/145* (2013.01); *B65B 43/185* (2013.01); *B65D 1/44* (2013.01);
(Continued)

(58) Field of Classification Search
CPC ..... B65B 25/00; B65B 43/145; B65B 43/185; B65B 43/44; B65B 43/46; B65B 2220/14;
(Continued)

(56) References Cited

U.S. PATENT DOCUMENTS 2,059,546 A * 11/1936 Brandenburg ..... B65B 43/44 221/220
3,436,231 A * 4/1969 Bruce et al. ..... B65D 1/34 426/132
(Continued)

FOREIGN PATENT DOCUMENTS

EP 2354036 A1 * 8/2011 ..... B65D 85/36
EP 2799350 A1 * 11/2014 ..... B65B 43/44
(Continued)

OTHER PUBLICATIONS

International Search Report and Written Opinion of the International Searching Authority issued in PCT/US2019/038343, dated Oct. 25, 2019; ISA/KR.
(Continued)

*Primary Examiner* — Stephen F. Gerrity
(74) *Attorney, Agent, or Firm* — Miller Johnson

(57) ABSTRACT

An apparatus for dispensing a single box for containing foodstuffs includes a housing, a lift subassembly, and a transfer subassembly. The housing at least partially defines an inner area. The lift subassembly is coupled to the housing and disposed at least partially within the inner area. The lift subassembly includes a nest configured to support a plurality of boxes disposed in a stack and translate with respect to the
(Continued)

housing in a first direction and a second direction opposite the first direction. The transfer subassembly is coupled to the housing and disposed at least partially within the inner area. The transfer subassembly includes a vacuum suction cup. The vacuum suction cup is configured to operatively engage a first box of the plurality of boxes to remove the first box from the stack and pivot the first box about a rotational axis to a surface outside of the inner area.

19 Claims, 9 Drawing Sheets

(51) Int. Cl.

| | |
|---|---|
| ***B65D 1/44*** | (2006.01) |
| ***B65D 25/10*** | (2006.01) |
| ***B65D 43/16*** | (2006.01) |
| ***B65B 43/14*** | (2006.01) |

(52) U.S. Cl.
CPC ..... *B65D 25/10* (2013.01); *B65D 43/162* (2013.01); *B65B 2220/14* (2013.01); *B65D 2251/1025* (2013.01); *B65D 2543/00083* (2013.01); *B65D 2543/00351* (2013.01); *B65D 2543/00398* (2013.01)

(58) Field of Classification Search
CPC ..... B65D 1/44; B65D 25/10; B65D 43/162; B65D 81/05; B65D 85/36; B65D 2251/1025; B65D 2543/00083; B65D 2543/00351; B65D 2543/00398
See application file for complete search history.

(56) References Cited

U.S. PATENT DOCUMENTS

| | | | | |
|---|---|---|---|---|
| 3,937,389 | A * | 2/1976 | Wind | B65D 43/162 229/406 |
| 2006/0099064 | A1 | 5/2006 | Anaki et al. | |
| 2007/0196541 | A1 | 8/2007 | Vovan et al. | |
| 2015/0196155 | A1 * | 7/2015 | Green et al. | B65D 43/162 426/511 |

FOREIGN PATENT DOCUMENTS

| | | | | |
|---|---|---|---|---|
| EP | 3208209 | A1 | 8/2017 | |
| FR | 2710031 | A1 * | 3/1995 | B65D 43/162 |
| JP | H0510214 | A | 1/1993 | |
| JP | H0510214 | U * | 2/1993 | B65D 43/162 |
| JP | H06179423 | A | 6/1994 | |
| JP | H11106057 | A | 4/1999 | |

OTHER PUBLICATIONS

International Preliminary Report on Patentability (Chapter II of the Patent Cooperation Treaty) in PCT/US2019/038343 (with 18 page annex), dated Jun. 19, 2020; IPEA/US.

* cited by examiner

BOX-DISPENSING APPARATUS, BOXES FOR USE IN THE BOX-DISPENSING APPARATUS, AND METHODS OF USING THE BOX-DISPENSING APPARATUS

CROSS-REFERENCE TO RELATED APPLICATIONS

This application is a National Stage of International Application No. PCT/US2019/038343 filed Jun. 20, 2019, which claims the benefit of U.S. Provisional Application No. 62/687,799 filed on Jun. 20, 2018. The entire disclosures of the above applications are incorporated herein by reference.

FIELD

The present disclosure relates generally to the field of automated food preparation and more specifically to automated systems and methods for packaging foodstuffs.

BACKGROUND

Preparation of foodstuffs (for example, hamburgers, sandwiches, etc.) according to a consumer's custom order can be time-consuming and labor-intensive. Furthermore, the process of preparing custom-ordered foodstuffs is susceptible to errors and wide variations in quality. The present disclosure provides an automated food preparation system that can quickly and accurately prepare foodstuffs according to a wide variety of possible custom orders with limited human involvement.

The background description provided here is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

SUMMARY

An apparatus for dispensing a single box for containing foodstuffs includes a housing, a lift subassembly, and a transfer subassembly. The housing at least partially defines an inner area. The lift subassembly is coupled to the housing. The lift subassembly is disposed at least partially within the inner area. The lift subassembly includes a nest. The nest is configured to support a plurality of boxes disposed in a stack. The nest is further configured to translate with respect to the housing in a first direction and a second direction opposite the first direction. The transfer subassembly is coupled to the housing. The transfer subassembly is disposed at least partially within the inner area. The transfer subassembly includes a vacuum suction cup. The vacuum suction cup is configured to operatively engage a first box of the plurality of boxes to remove the first box from the stack and pivot the first box about a rotational axis to a surface outside of the inner area.

In other features, the apparatus further includes a separator subassembly. The separator subassembly is coupled to the housing. The separator subassembly is disposed at least partially within the inner area. The separator subassembly includes an arm. The arm is configured to translate with respect to the housing between a retracted position and an extended position. In the retracted position, the arm is disengaged from the plurality of boxes. In the extended position, the arm is configured to engage at least one of the first box or a second box adjacent to the first box in the stack.

In other features, the arm in the extended position is configured to engage the second box to retain the second box on the stack while the transfer subassembly removes the first box from the stack.

In other features, the arm includes a first arm and a second arm. The first arm is configured to translate with respect to the housing between a first retracted position and a first extended position independent of the second arm. The second arm is configured to translate with respect to the housing between a second retracted position and a second extended position independent of the first arm.

In other features, the first arm in the first extended position is configured to cooperate with the second arm in the second extended position to retain the first box between the first arm and the second arm. The first arm is configured to prevent translation of the first box in the second direction. The second arm is configured to prevent translation of the first box in the first direction.

In other features, the arm is pivotable with respect to the housing between a first separator position and a second separator position.

In other features, the arm is disposed in the second direction with respect to the stack. The arm is configured to pivot from the first separator position to the second separator position via engagement with the first box when the lift subassembly translates the stack in the second direction. The arm is configured to automatically return to the first separator position from the second separator position upon disengagement with the first box when the lift subassembly translates the stack in the first direction.

In other features, the vacuum suction cup is configured to translate between a retracted position and an extended position with respect to the housing.

In other features, the vacuum suction cup is configured to pivot about at least one of a first pivot axis substantially parallel to the rotational axis and a second pivot axis substantially perpendicular to the rotational axis.

In other features, the transfer subassembly further includes an optical sensor. The optical sensor is configured to pivot about the rotational axis together with the vacuum suction cup.

In other features, the vacuum suction cup includes a first vacuum suction cup and a second vacuum suction cup. The first vacuum suction cup is configured to operatively engage a first portion of the first box. The second vacuum suction cup is configured to operatively engage a second portion of the first box.

In other features, the first vacuum suction cup and the second vacuum suction cup are configured to pivot together about the rotational axis. The first vacuum suction cup and the second vacuum suction cup are configured to translate together between a retracted position and an extended position. The first vacuum suction cup and the second vacuum suction cup are configured to independently pivot about respective first pivot axes substantially parallel to the rotational axis and respective second pivot axes substantially perpendicular to the rotational axis.

In other features, the transfer subassembly is configured to pivot the first box through an angle about 180° about the rotational axis between a grip position and a placement position. The first box has an open side disposed toward the first direction in the grip position and the second direction in the placement position.

In other features, the lift subassembly further includes a plurality of posts extending substantially parallel to the first direction and the second direction. The nest is disposed within a perimeter at least partially defined by the plurality of posts. The plurality of posts is configured to cooperate with the nest to retain the stack within the inner area.

A box for containing foodstuffs includes a first portion, a second portion, and a joint. The first portion includes a curved wall having a first perimeter. The first perimeter includes a first edge, a second edge, and a centerline extending between the first edge and the second edge. The curved wall defines a substantially V-shaped projection disposed between the first edge and the centerline. The V-shaped projection includes a first leg, a second leg, and a peak connecting the first leg and the second leg. The first leg extends from the peak to an intersection of the centerline and the first edge. The second leg extends from the peak to an intermediate point adjacent to the first edge. A second portion includes a floor and a peripheral wall surrounding the floor and extending from the floor. The peripheral wall has a second perimeter. At least a portion of the floor is substantially planar. A joint pivotally connects the curved wall of the first portion and the peripheral wall of the second portion such that the box is movable between a closed position and an open position. The first portion and the second portion cooperate to define a compartment in the closed position. The curved wall is convex with respect to the compartment. The substantially V-shaped projection is concave with respect to the compartment.

In other features, the first perimeter and the second perimeter are substantially lens shaped.

In other features, the curved wall further includes a first elongated projection, a second elongated projection, and a third elongated projection. The first elongated projection is disposed between the centerline and the second edge. The first elongated projection is disposed opposite the V-shaped projection with respect to the centerline. The second elongated projection is disposed between the first edge and the centerline. The second elongated projection is spaced apart from the V-shaped projection along the centerline. The third elongated projection is disposed between the second edge and the centerline. The third elongated projection is spaced apart from the first elongated projection along the centerline. The third elongated projection is disposed opposite the second elongated projection with respect to the centerline. The first elongated projection, the second elongated projection, and the third elongated projection are concave with respect to the compartment.

In other features, the peripheral wall defines a first height adjacent to the joint and a second height opposite the joint. The first height is greater than the second height.

In other features, the floor includes a stage and a channel. The stage projects into the compartment. The stage configured to support foodstuffs. The channel is at least partially defined by the stage and the peripheral wall.

A method of dispensing a box from an apparatus includes providing a plurality of boxes disposed in a stack within an inner area of a housing of the apparatus. The apparatus includes a housing, a lift subassembly coupled to the housing, and a transfer subassembly coupled to the housing. The lift subassembly includes a nest. The nest is configured to translate in a first direction and a second direction opposite the first direction with respect to the housing. The nest is configured to be disposed in the first direction with respect to the stack and support the stack. The method further includes positioning a box of the plurality of boxes in a gripping position by operating the lift subassembly to translate the stack in the second direction. The method further includes gripping the box operating a pump to operatively engage a vacuum suction cup of a transfer subassembly with the box. The transfer subassembly is coupled to the housing and disposed at least partially within the inner area. The method further includes operating the transfer subassembly to pivot the box about a rotational axis from the grip position to a placement position outside of the inner area. The method further includes dispensing the box onto a surface by operating the pump to disengage the box from the vacuum suction cup.

Further areas of applicability of the present disclosure will become apparent from the detailed description, the claims, and the drawings. The detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings.

In the drawings, reference numbers may be reused to identify similar and/or identical elements.

DETAILED DESCRIPTION

Figure 1:
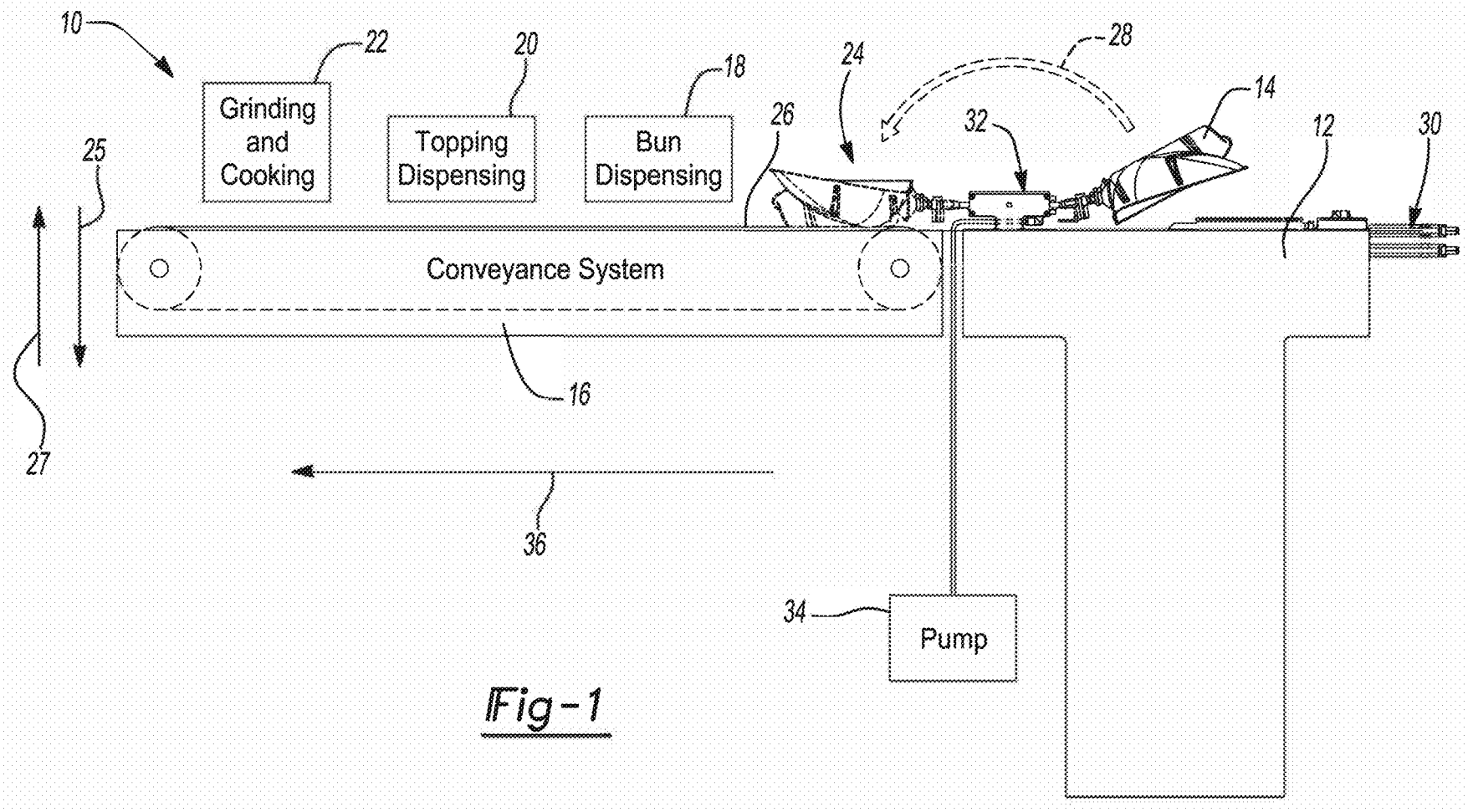
FIG. 1 is a schematic representation of an automated food preparation system according to the principles of the present disclosure.

In FIG. 1, an example of an automated food preparation system 10 according to various implementations of the present disclosure is provided. The automated food preparation system 10 includes a box-dispensing apparatus 12 (also referred to as a container-dispensing apparatus) for placing a container or box 14 onto a conveyance system 16. The box-dispensing apparatus 12 transfers the box 14 to the conveyance system 16 for transport to one or more stations, such as a bun-dispensing apparatus 18, a toppings-dispensing apparatus 20, and a grinding and cooking apparatus 22.

The box-dispensing apparatus 12 holds multiple boxes, which may be similar to the box 14, such as in a vertically-oriented stack. The box-dispensing apparatus 12 dispenses the boxes one-at-a-time as needed to progress through the automated food preparation system 10. The box-dispensing apparatus 12 moves the box 14, also referred to as the "top box" or "first box" from a grip position (shown in solid lines) to a placement position (shown in dashed lines).

In the grip position, the box 14 is on or adjacent to an end of a stack of boxes, such as at the top of the stack of boxes. The box 14 has an open side 24 that faces a first or downward direction 25 (for example, a direction substantially perpendicular to a surface on which the box-dispensing apparatus sits). In the placement position, the box 14 is disposed on a conveyor surface 26 of the conveyance system 16 such that the box 14 can be transported by the conveyance system 16. In the placement position, the open side 24 of the box 14 faces a second or upward direction 27 to receive foodstuffs. The box-dispensing apparatus 12 moves the box 14 through an arc between the grip position and the placement position, as indicated by the arrow 28. In certain aspects, the box-dispensing apparatus 12 may move the box 14 through an angle of about 180° from the grip position to the placement position.

The box-dispensing apparatus 12 includes a separator subassembly 30 (FIG. 4) and a transfer or gripper subassembly 32 (FIG. 5), which are described in greater detail below. The separator subassembly 30 prevents the top box from sticking to an adjacent box to ensure that only a single box is disposed at one time. The separator subassembly 30 generally provides a mechanical stop between the box 14 to be dispensed and the adjacent box. The separator subassembly 30 also facilitates proper positioning of the top box prior to and/or during engagement with the gripper subassembly 32.

The gripper subassembly 32 can engage the box 14 and maintain engagement as the box 14 travels from the grip position to the placement position. The gripper subassembly 32 can operatively engage the box 14 through use of a vacuum system driven by a pump 34. During transfer from the grip position to the placement position, the gripper subassembly 32 rotates the box 14 from an open-side-down configuration in the grip position to an open-side-up position in the placement position. In various other implementations, a box dispensing apparatus may deposit the box 14 onto the conveyance system 16 without rotating the box 14. For example, if a box is disposed with an open side facing upward in the grip position, a gripper subassembly may lift the box off of a stack of boxes and transport it to the placement position via a sweep that is substantially parallel to a conveyor surface.

The conveyance system 16 transports the box 14 in a conveyance direction 36 to deliver it to one or more stations, such as the bun-dispensing apparatus 18, the toppings-dispensing apparatus 20, and the grinding and cooking apparatus 22. The bun-dispensing apparatus 18 may include multiple subsystems, such as a bun slicing subsystem that slices a bun, a bun buttering subsystem that applies butter to each side of the bun, and a bun toaster subsystem that toasts portions (for examples, halves) of the bun before or after buttering. The toppings-dispensing apparatus 20 may include multiple subsystems that prepare and load toppings, seasonings, and sauces onto the bun based on custom topping orders. The grinding and cooking apparatus 22 may include multiple subsystems, such as a grinding subsystem that grinds a protein, like meat, a patty subsystem that forms a patty from the ground protein, and a cooking subsystem that cooks the patty. One skilled in the art will appreciate that the automated food processing system 10 may include different or additional systems and subsystems.

Figure 2:
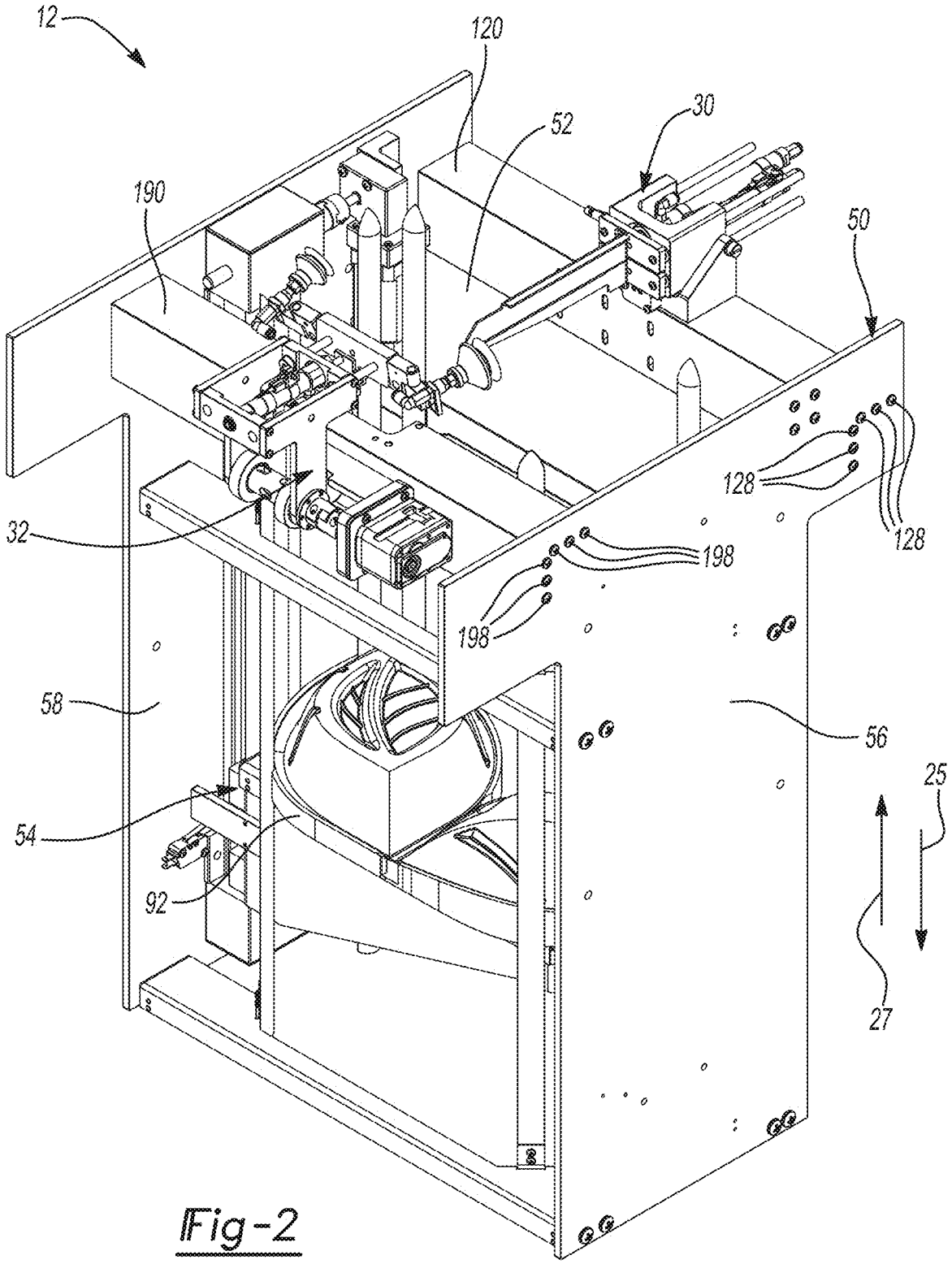
FIG. 2 is a perspective view of a box-dispensing apparatus of the automated food preparation system of FIG. 1.

In FIG. 2, an example of the box-dispensing apparatus 12 according to various implementations of the present disclosure is provided. The box-dispensing apparatus 12 includes a housing 50 that at least partially defines an inner area 52. The box-dispensing apparatus 12 generally includes a lifting subassembly 54 (FIG. 3), the separator subassembly 30 (FIG. 4), and the gripper subassembly 32 (FIG. 5). Each of the subassemblies 54, 30, 32 is coupled to the housing 50 and disposed at least partially within the inner area 52 of the housing 50. Portions of each subassembly 54, 30, 32 may be movable with respect to the housing 50.

Figure 3:
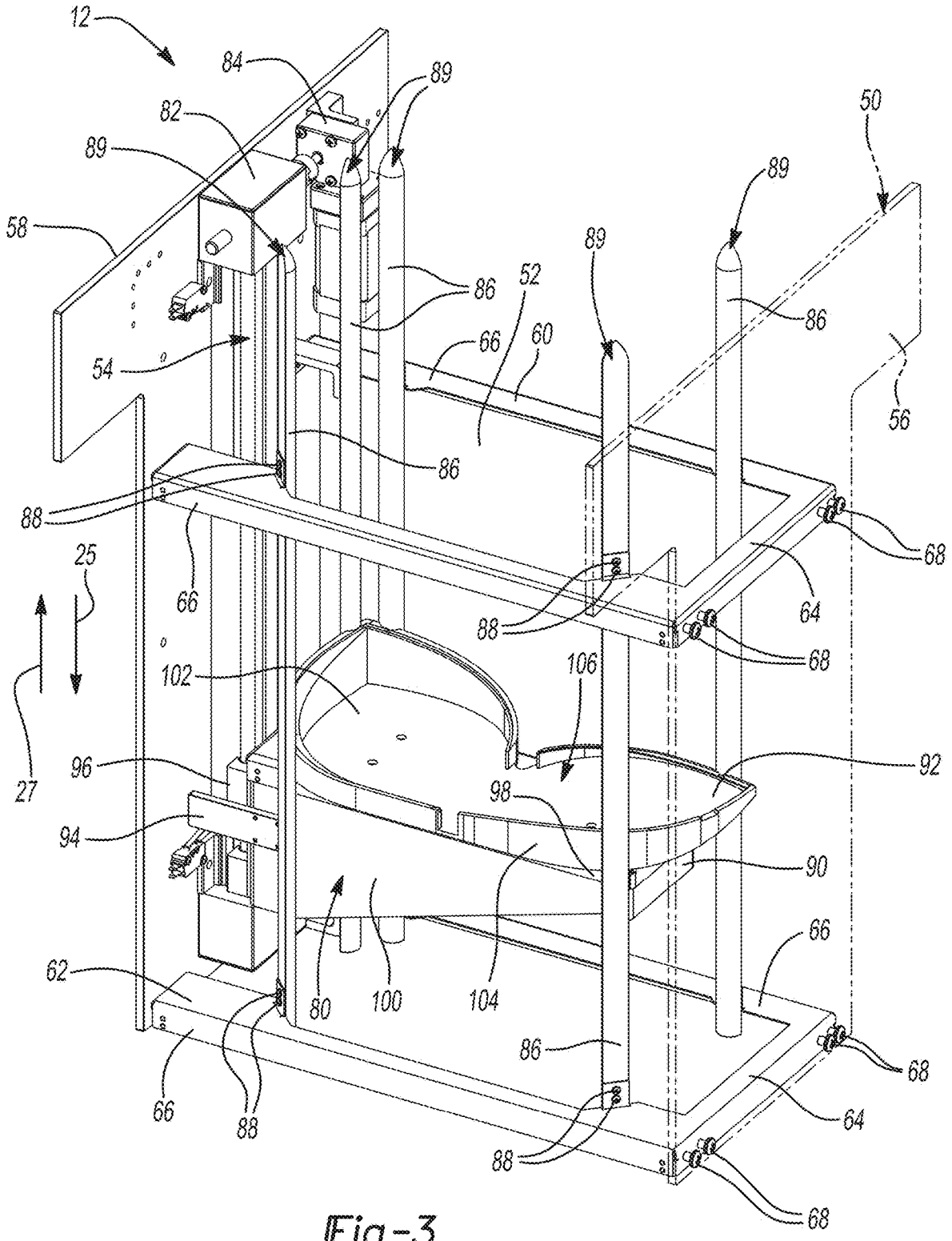
FIG. 3 is a partial perspective view of the box-dispensing apparatus of FIG. 2 showing a lifting assembly.

In FIG. 3, the housing 50 includes a first wall 56 and a second wall 58. The first and second walls 56, 58 are spaced apart from one another and disposed on opposite sides of the housing 50. The first and second walls 56, 58 extend substantially parallel to one another and have identical profiles. In various implementations, each of the first and second walls 56, 58 includes a T-shaped profile. The first and second walls 56, 58 provide structural support for the box-dispensing apparatus 12. When the box-dispensing apparatus 12 is arranged in the automated food preparation system 10, the first wall 56 may face a viewing area. Accordingly, when the first wall 56 is opaque, the stack of boxes may be concealed with respect to the viewing area.

The housing 50 further includes one or more supports, such as a first or upper support 60 and a second or lower support 62, to couple and structurally support the first and second walls 56, 58. The lower support 62 acts as a base to engage a surface upon which the box-dispensing apparatus 12 is disposed. Each of the supports 60, 62 has a generally U-shaped profile including a connecting beam 64 and a pair of transverse beams 66. The transverse beams 66 (that is, respective longitudinal axes of the transverse beams 66) extend substantially parallel to one another and substantially perpendicular to the first and second wall 56, 58. The connecting beams 64 are each coupled to the first wall 56. The upper and lower supports 60, 62 may be directly coupled to the first and second walls 56, 58, such as by a first plurality of fasteners 68. The housing 50 may include different or additional walls and/or supports depending on packaging constraints and structural requirements.

The lifting subassembly 54 provides boxes to the separator and gripper subassemblies 30, 32 (FIG. 2). The lifting subassembly 54 generally includes a platform subassembly 80, a linear actuator 82, a first motor 84, and a plurality of box guides, such as posts 86. The posts 86 may extend substantially parallel to the first and second directions 25, 27. That is, the posts 86 may extend substantially vertically.

The platform subassembly 80 supports a stack of boxes. The linear actuator 82 translates the platform subassembly 80 along a path generally parallel to the first and second directions 25, 27. In various implementations, the path may be substantially vertical. The first motor 84 operatively engages the linear actuator and provides power to the linear actuator 82. The posts 86 provide lateral support to the stack of boxes to prevent the boxes from falling out of the stack and retain the boxes within the inner area 52 of the housing 50.

The lifting subassembly 54 may include five posts 86. The posts 86 are coupled to the upper and lower supports 60, 62, such as by a second plurality of fasteners 88. The posts 86 extend from the lower support 62 to the upper support 60, and beyond the upper support 60. The posts 86 extend substantially perpendicular to the surface on which the box-dispensing apparatus 12 is disposed and substantially parallel to one another. In various implementations, the posts extend substantially vertically. Each post 86 includes a distal end 89 that is tapered. The taper can act as a guide when a stack of boxes 14 is loaded into the box-dispensing apparatus 12.

The posts 86 cooperate to define an area into which the platform subassembly 80 is disposed. The platform subassembly 80 is operatively coupled to the linear actuator 82. The platform subassembly 80 includes a first base 90, a nest 92, a pair of guards 94, and one or more connectors 96. The first base 90 includes a top wall 98 and two opposing side walls 100. The top wall 98 extends between the two side walls 100. Each side wall 100 has a profile that substantially defines a portion of a right-triangular shape.

The nest 92 includes a bottom wall 102 and a peripheral wall 104. The peripheral wall 104 extends generally in the upward direction 27 from the bottom wall 102. The bottom wall 102 and the peripheral wall 104 cooperate to define a receptacle 106 for the stack of boxes (FIG. 2). The receptacle 106 is sized and shaped to complement a perimeter of the box 14. As shown in FIG. 2, the nest 92 is configured to support the stack of boxes. The nest 92 is coupled to the first base 90. Specifically, the bottom wall 102 of the nest 92 is coupled to the top wall 98 of the first base 90. In various implementations, the nest 92 is removable from the first base 90. The nest 92 may be removed for cleaning, replacement with a different nest, such as a nest that conforms to a different box shape, for example.

The first base 90 is coupled to the linear actuator 82 through the connectors 96. The guards 94 extend from the first base 90 toward the second side wall 58. The guards 94 are disposed on opposing sides of the linear actuator 82.

The first motor 84 provides power to the linear actuator 82 for translating the platform subassembly 80 between a first or bottom platform position and a second or top platform position. The linear actuator 82 generally moves the platform subassembly 80 in the upward direction 27 as boxes 14 are dispensed. The linear actuator 82 moves the platform subassembly 80 in the downward direction 25 to adjust a position of the box 14 during operation of the box-dispensing apparatus 12 once the stack of boxes has been replenished (for example, prior to loading additional boxes into the nest 92), or after loading additional boxes into the nest 92 but prior to resuming operation of the box-dispensing apparatus 12. The linear actuator 82 can incrementally or continuously translate the platform subassembly 80.

In various implementations, the linear actuator 82 is lead screw driven and includes a first limit switch and a second limit switch (not shown). However, the box-dispensing apparatus may include different linear actuators or mechanisms for translating the nest 92. In one example, the nest 92 is translated by a belt-pulley system (not shown). In another example, the nest 92 is spring-biased and configured to translate by a predetermined value once a box is removed from the stack (not shown).

Figure 4:
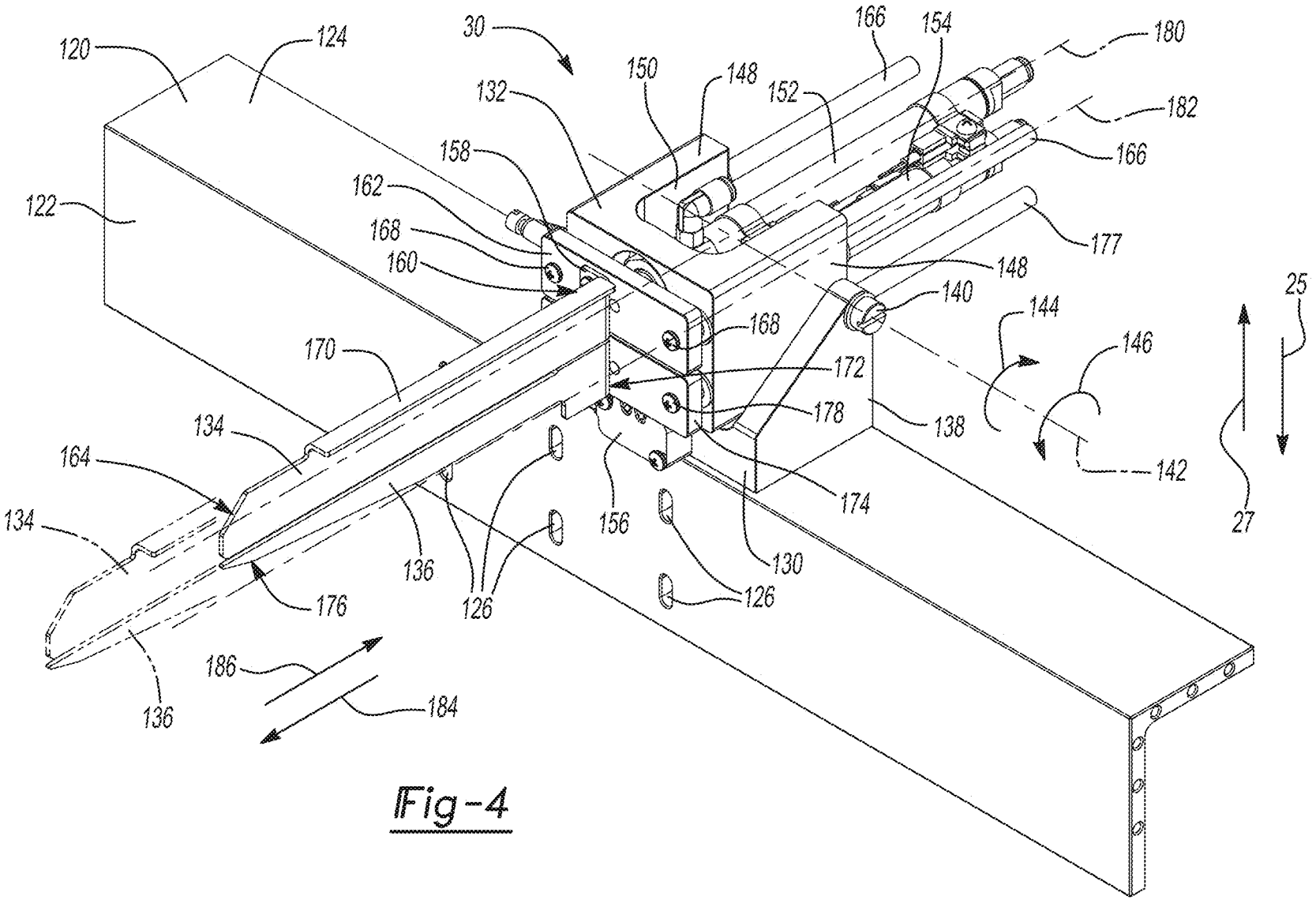
FIG. 4 is a partial perspective view of a separator subassembly of the box-dispensing apparatus of FIG. 2.
Figure 5:
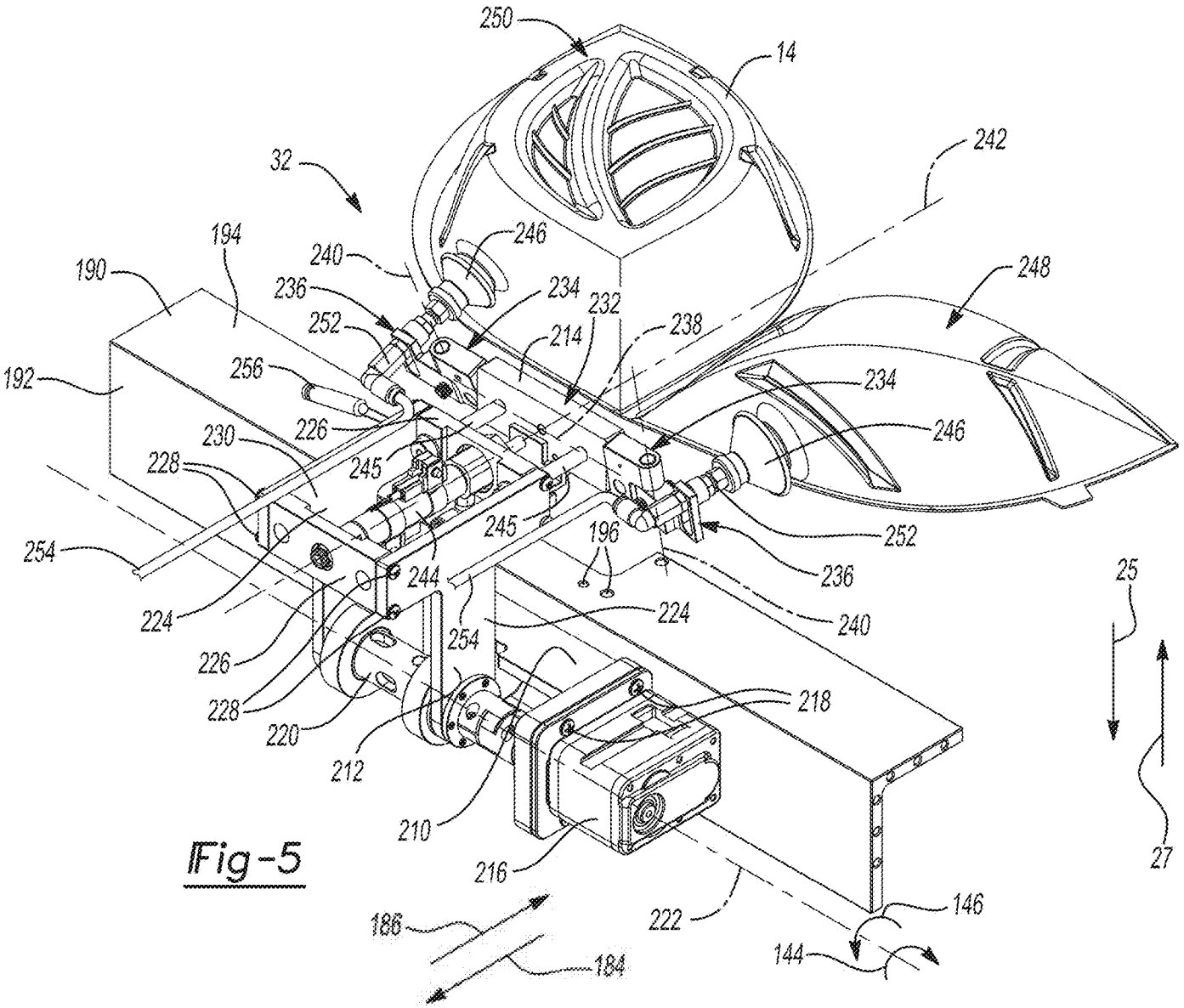
FIG. 5 is a perspective view of a gripper subassembly of the box-dispensing apparatus of FIG. 2.

In FIG. 4, the separator subassembly 30 is shown. The separator subassembly 30 is used to: (i) determine a height of the stack of boxes; (ii) facilitate the separation of a single box from the top of the stack; and (iii) maintain a position of the box 14 while the gripper subassembly adjusts its position to engage the box 14. Separation of a single box from the top of the stack may be referred to as "de-nesting." The separator subassembly 30 facilitates separation of the boxes by ensuring that the box 14 does not stick to an adjacent box in the stack (also referred to as a "second-from-the-top box" or a "second box") when the gripper subassembly 32 engages the box 14. In various other implementations, the height of the stack of boxes may be determined using other methods that do not require the separator subassembly 30.

The separator subassembly 30 is coupled to a first support beam 120. The first support beam 120 includes a first wall 122 and a second wall 124 that extend substantially perpendicular to one another. In various implementations the first wall 122 may extend substantially vertically and the second wall 124 may extend substantially horizontally. The first wall 122 and the second wall 124 cooperate to define an L-shaped cross section.

The first wall 122 defines a first plurality of apertures 126. As shown in FIG. 2, the first support beam 120 extends between the first wall 56 and the second wall 58. The first support beam 120 is coupled to the first and second walls 56, 58 by a third plurality of fasteners 128.

Returning to FIG. 4, the separator subassembly 30 generally includes a second base 130, a pivotable body 132, a first or upper stabber arm 134, and a second or lower stabber arm 136. The second base 130 is coupled to the second wall 124 of the first support beam 120. The pivotable body 132 is rotatably coupled to the housing via the second base 130. The upper and lower stabber arms 134, 136 are slidingly coupled to the pivotable body 132. The second base 130 includes a pair of opposing side walls 138 between which the pivotable body 132 is at least partially disposed. The side walls 138 may be sloped such that the decrease in height toward a center of the inner area 52 of the housing 50.

The pivotable body 132 is coupled to the second base 130 by a fourth plurality of fasteners 140. The pivotable body 132 is rotatable with respect to the second base 130 about a first rotational axis 142. The first rotational axis 142 extends through the fourth fasteners 140. More particularly, the pivotable body 132 is pivotable in a first rotational direction 144 between a first separator position (FIG. 4) and a second separator position (not shown). The second separator position is greater than 0° and less than about 90° from the first separator position in the first rotational direction 144. The second separator position is optionally greater than 0° and less than or equal to about 45°, optionally greater than 0° and less than or equal to about 30°, optionally greater than 0° and less than or equal to about 15°, optionally greater than 0° and less than or equal to about 10°, or optionally greater than 0° and less than or equal to about 5° from the first separator position in the first rotational direction 144.

The pivotable body 132 is biased in the first separator position, such as by a spring (not shown). Thus, the pivotable body 132 is configured to automatically return to the first separator position from the second separator position. The pivotable body 132 is pivotable in a second rotational direction 146 opposite the first rotational direction 144 to return the pivotable body 132 from the second separator position to the first separator position.

The separator subassembly 30 further includes a third limit switch (not shown) to prevent the pivotable body 132 from rotating past the second separator position in the first rotational direction 144. The pivotable body 132 is mechanically prevented from moving past the first separator position in the second rotational direction 146 due to physical engagement of the pivotable body 132 with the second base 130.

The pivotable body 132 defines a substantially U-shaped cross section. Opposing sides 148 of the pivotable body 132 are spaced apart to define an interior region 150. The upper and lower stabber arms 134, 136 are coupled to the pivotable body 132 and configured to translate with respect to the pivotable body 132 independent of one another. The upper stabber arm 134 is driven by a first linear actuator 152. The lower stabber arm 136 is driven by a second linear actuator 154. The first and second linear actuators 152, 154 are at least partially disposed in the interior region 150 of the pivotable body 132. A second motor 156 supplies power to the first and second linear actuators 152, 154. In various other implementations, separate motors supply power to the first and second linear actuators 152, 154.

The upper stabber arm 134 includes a first flange 158 disposed at a first proximal end 160. The upper stabber arm 134 is fixed to a first bar 162 at the first flange 158. A first distal end 164 of the upper stabber arm 134 is tapered in height (in a direction substantially parallel to the first and second directions 25, 27). A first pair of guide pins 166 is fixed to the first bar 162 by a fifth plurality of fasteners 168. The first pair of guide pins 166 extend through and are configured to slidingly engage surfaces of respective apertures defined in the pivotable body 132. The engagement between the first pair of guide pins 166 and the pivotable body 132 provides mechanical support to the upper stabber arm 134. The upper stabber arm 134 further includes a lip 170 that extends toward the first side wall 56 when the separator subassembly 30 is coupled to the housing 50 (FIG. 2).

The lower stabber arm 136 includes a second flange (not shown, similar to the first flange 158) disposed at a second proximal end 172. The lower stabber arm 136 is coupled to a second bar 174 at the second flange. A second distal end 176 of the lower stabber arm 136 is tapered in height (for example, in a direction substantially parallel to the first and second directions 25, 27). A second pair of guide pins 177 is coupled to the second bar 174 by a sixth plurality of fasteners 178. The second pair of guide pins 177 extend through and are configured to slidingly engage surfaces of respective apertures defined in the pivotable body 132. The engagement between the second pair of guide pins 177 and the pivotable body 132 provides mechanical support to the lower stabber arm 136.

The upper stabber arm 134 is configured to move between a first retracted position (shown in solid lines) and a first extended position (shown in dashed lines). The upper stabber arm 134 moves between the first retracted position and the first extended position by translating along a first or upper stabber axis 180. In the first extended position, the upper stabber arm 134 is configured to engage an outer surface of the box 14 (FIG. 2) on the stack of boxes. In the first retracted position, the upper stabber arm 134 is disengaged from the stack of boxes.

The lower stabber arm 136 is configured to move between a second retracted position (shown in solid lines) and a second extended position (shown in dashed lines). The lower stabber arm 136 moves between the second retracted position and the second extended position by translating along a second or lower stabber axis 182. In the second extended position, the lower stabber arm 136 is configured to engage an outer surface of the second-from-the-top box on the stack of boxes to hold the second-from-the-top box in place on the stack while the top box is removed, as will be described in greater detail below. In the second retracted position, the lower stabber arm 136 is disengaged from the stack of boxes.

The upper and lower stabber arms 134, 136 move in a third direction 184 from the respective first and second retracted positions to the first and second extended positions. The third direction 184 is substantially perpendicular to the first and second directions 25, 27. The upper and lower stabber arms 134, 136 move in a fourth direction 186 opposite the third direction 184 from the respective first and second extended positions to the respective first and second retracted positions. The fourth direction 186 is substantially perpendicular to the first and second directions 25, 27.

FIG. 5 shows the gripper subassembly 32, which transfers individual boxes from the stack of boxes to the conveyance system 16. Specifically, the gripper subassembly 32 engages the box 14 from the stack of boxes, lifts the box 14 off of the stack, and rotates the box 14 to place the box 14 outside of the inner area 52 of the housing 50. More particularly, the gripper subassembly 32 places the box 14 on the conveyor surface 26 of the conveyance system 16.

The gripper subassembly 32 is coupled to a second support beam 190. The second support beam 190 includes a third wall 192 and a fourth wall 194 that extend substantially perpendicular to one another. The third wall 192 may be substantially vertical and the fourth wall 194 may be substantially horizontal. The third wall 192 and the fourth wall 194 cooperate to define an L-shaped cross section. The fourth wall 194 defines a second plurality of apertures 196. As shown in FIG. 2, the second support beam 190 extends between the first wall 56 and the second wall 58. The second support beam 190 is coupled to the first and second walls 56, 58 by a seventh plurality of fasteners 198.

Returning to FIG. 5, the gripper subassembly 32 generally includes a third base 210, a flipper 212, a gripper arm 214, and a motor 216. The third base 210 is coupled to the third wall 192 of the second support beam 190. The motor 216 is coupled to the third base 210. The flipper 212 is operably coupled to the motor 216 and configured to pivot with respect to the third base 210 (and therefore the housing 50). The gripper arm 214 is slidingly coupled to the flipper 212.

The motor 216 is coupled to the third base 210 through an eighth plurality of fasteners 218. The flipper 212 is operatively coupled to the motor 216 through an axle 220. The flipper 212 is configured to rotate about a second rotational axis 222 between the grip position (FIG. 5) and the placement position (FIG. 1, shown in dashed lines). The flipper 212 moves in the second rotational direction 146 about the second rotational axis 222 from the grip position to the placement position. The flipper 212 moves in the first rotational direction 144 about the second rotational axis 222 from the placement position to return to the grip position.

The flipper 212 includes a pair of opposing T-shaped side walls 224 that are spaced apart from one another. The T-shaped side walls 224 extend substantially parallel to one another. The flipper 212 further includes a pair of opposing connector walls 226. The connector walls 226 extend substantially parallel to one another. The connector walls 226 extend substantially perpendicular to the T-shaped side walls 224. Each connector wall 226 extends between the T-shaped side walls 224 and is coupled to each of the T-shaped side walls 224 by a ninth plurality of fasteners 228. The T-shaped side walls 224 and the connector walls 226 cooperate to define an interior flipper area 230.

The gripper arm 214 is slidingly coupled to the flipper 212. The gripper arm 214 includes a center portion 232, two intermediate portions 234, and two outer portions 236. Each intermediate portion 234 is disposed laterally between the center portion 232 and a respective outer portion 236. The intermediate portions 234 are pivotable with respect to the center portion 232 about respective first pivot axes 238 that extends laterally though the center portion 232. The first pivot axes 238 may be substantially parallel to the second rotational axis 222. The outer portions 236 are pivotable with respect to the respective intermediate portions 234 about respective second pivot axes 240. The second pivot axes 240 extend substantially perpendicular to the first pivot axes 238.

The gripper arm 214 is configured to translate along a gripper axis 242 between a third retracted position (not shown) and a third extended position (FIG. 5) along a gripper axis 242. The gripper arm 214 is disposed closer to the flipper 212 in the third retracted position than in the third extended position. The gripper arm 214 moves between the third extended and retracted positions to engage or disengage a box, and to clear other components of the automated food preparation system 10 (FIG. 1) as the flipper 212 rotates about the second rotational axis 222. The gripper arm 214 is moved between the third retracted position and the third extended position by a linear actuator 244, which is at least partially disposed within the interior flipper area 230.

As the gripper arm 214 translates along the gripper axis 242, a third pair of guide pins 245 slidingly engage respective apertures in the flipper 212. The gripper arm 214 translates along the gripper axis 242 in the fourth direction 186 between the third retracted position and the third extended position. The gripper arm 214 translates along the gripper axis 242 in the third direction 184 from the third extended position to the third retracted position.

The gripper arm 214 further includes two grippers, such as vacuum suction grippers 246. The suction grippers 246 engage respective top and bottom portions 248, 250 of the box 14. The suction grippers 246 are coupled to the gripper arm 214 such they are pivotable about the first and second pivot axes 238, 240 and translatable along the gripper axis 242. Thus, each of the suction grippers 246 has three degrees of freedom with respect to the flipper 212.

The suction grippers 246 are coupled to the outer portions 236 of the gripper arm 214 through respective hollow shafts 252. An interior portion of each hollow shaft 252 is fluidly connected to a flexible tube 254 that is fluidly connected to the pump 34 (FIG. 1). The pump 34 is configured to draw air through the suction grippers 246 while the suction grippers 246 are in communication with the box 14 to removably couple the box 14 to the gripper arm 214 by way of vacuum pressure. In various implementations, the pump 34 may be used to create a continuous vacuum flow.

The gripper subassembly 32 further includes an optical sensor 256. The optical sensor 256 is coupled to the flipper 212 and configured to rotate together with the flipper 212. The optical sensor 256 detects a distance between the optical sensor 256 and a surface of the box 14. The detected distance is used to determine whether (1) a box is present to be gripped, (2) the box has been successfully gripped, and (3) the box has completed the rotation from the grip position to the placement position. When the flipper 212 is in the grip position, the detected distance can be compared to a predetermined distance range to determine whether the box has been successfully gripped. When the flipper 212 is in the placement position, the detected distance can be compared to a second predetermined distance range to determine whether the box has completed the rotation to be placed on the conveyance system 16 (FIG. 1).

Figure 6:
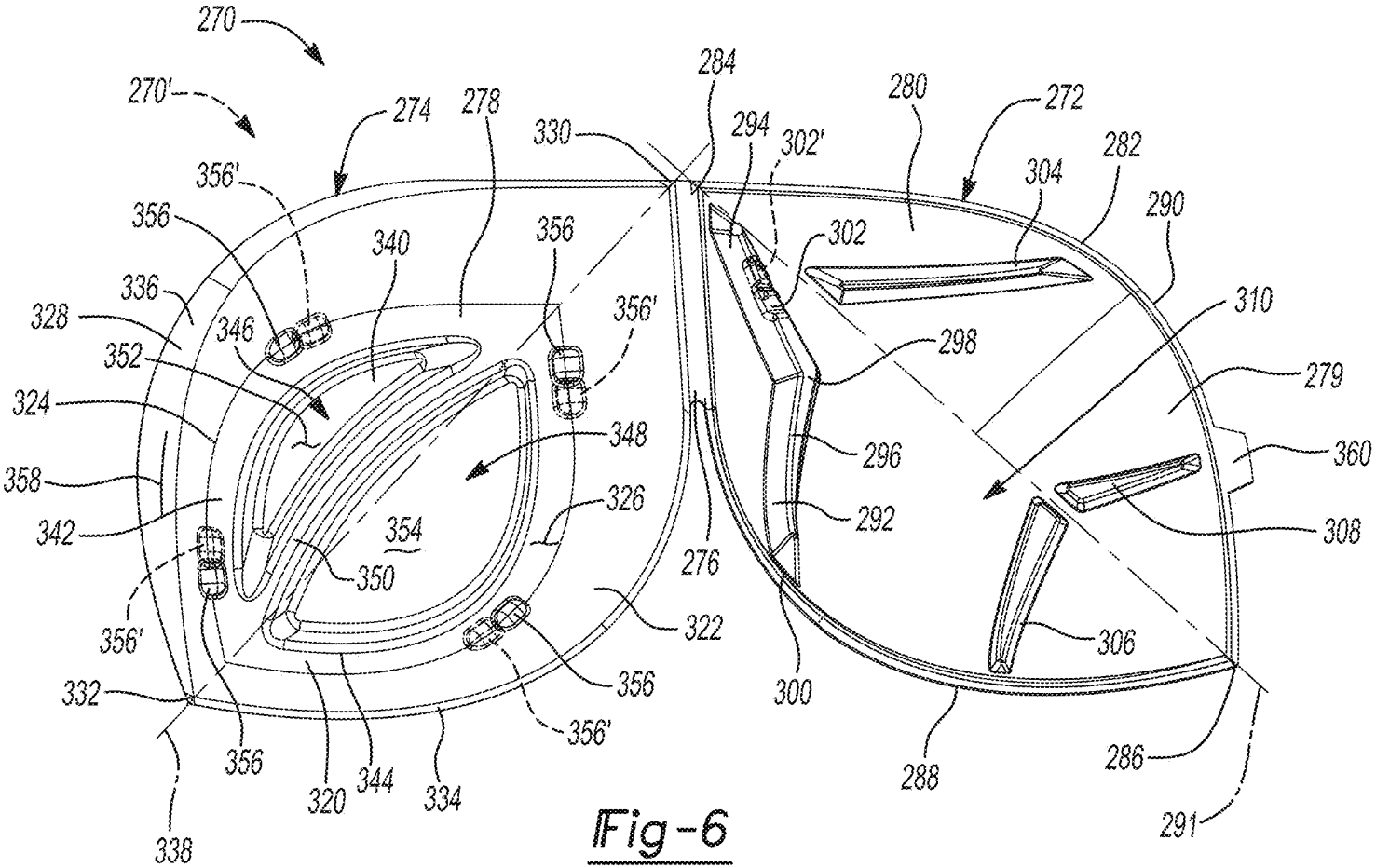
FIG. 6 shows a perspective view of a box according to the principles of the present disclosure.
Figure 7:
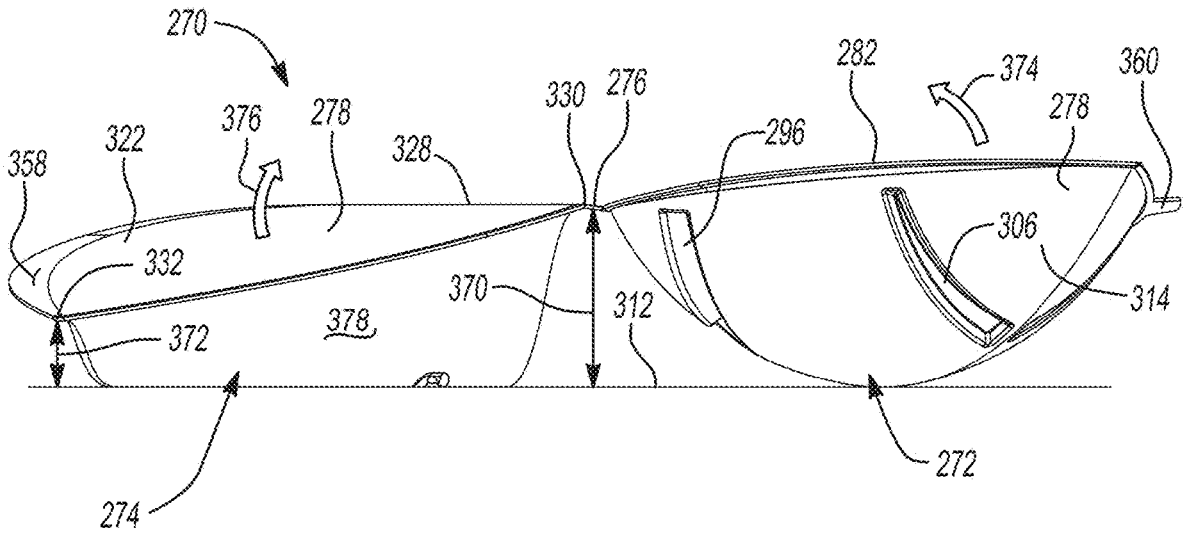
FIG. 7 shows a side view of the box of FIG. 6.

FIGS. 6-7 show examples of a box 270 according to various implementations of the present disclosure. The box 270 includes a first or top portion 272 and a second or bottom portion 274. The top portion 272 is pivotally connected to the bottom portion 274 at a joint 276. In various implementations, the joint 276 may be a living hinge. The top portion 272, the bottom portion 274, and the joint 276 may be integrally formed as a single piece.

The box 270 can be transitioned between an open position (FIGS. 6-7) and a closed position (not shown) by pivoting at least one of the top portion 272 and the bottom portion 274 about the joint 276. In the closed position, the top and bottom portions 272,274 cooperate to define a compartment 278. The compartment 278 can be used to contain foodstuffs, such as a burger. In one example, when the box 270 is in the open position, it contains a burger bun, where a crown or top half of the bun is disposed in the top portion 272 of the box and a heel or bottom half of the bun is disposed in the bottom portion 274 of the box 270.

The top portion 272 includes an upper wall 279 having a first inner surface 280. The upper wall 279 has a curved or contoured profile. Accordingly, in various implementations, the upper wall 279 may be referred to as a "curved wall." The upper wall 279 and first inner surface 280 are convex with respect to the compartment 278. The upper wall 279 is therefore dome-shaped. The dome may have a non-circular base as defined by the first perimeter 282.

The first perimeter 282 may define a substantially elliptical shape having pointed ends. Accordingly, in various implementations, the first perimeter 282 may be substantially lens shaped.

The first perimeter 282 includes a first proximal point 284, a first distal point 286, a first exterior edge 288, and a second exterior edge 290. The first proximal point 284 is disposed adjacent to the joint 276. The first exterior edge 288 extends between the first proximal point 284 and the first distal point 286, at least partially along the joint 276. The second exterior edge 290 extends between the first proximal point 284 and the first distal point 286, opposite the first exterior edge 288. A first centerline 291 extends across the shortest distance between the first proximal point 284 and the first distal point 286. The first centerline 291 extends between the first exterior edge 288 and the second exterior edge 290. The first proximal point 284 is disposed at a first intersection of the first exterior edge 288, the second exterior edge 290 and the first centerline 291. The first distal point 286 is disposed at a second intersection of the first exterior edge 288, the second exterior edge 290, and the first centerline 291. Both the first exterior edge 288 and the second exterior edge 290 are convex with respect to the first centerline 291. In various implementations, the first perimeter 282 may be substantially symmetric about the first centerline 291.

The top portion 272 includes a plurality of surface features to facilitate loading and orienting foodstuffs into the compartment 278 and to improve aesthetics of the box 270. The top portion 272 includes a substantially V-shaped projection 292 extending from the first inner surface 280. The V-shaped projection 292 extends into the compartment 278 when the box 270 is in the closed position. Thus, the V-shaped projection 292 is concave with respect to the compartment 278. The V-shaped projection 292 includes a first leg 294 and a second leg 296 that converge at a peak 298. The first leg 294 extends from adjacent to the first proximal point 284 to the peak 298. The second leg 296 extends from the peak 298 to an intermediate location 300 adjacent to the first exterior edge 288. The V-shaped projection 292 is disposed between the first centerline 291 and the first exterior edge 288. The first leg 294 defines an indent 302 that projects away from the compartment 278 when the box 270 is in the closed position. Thus, the indent 302 is convex with respect to the compartment 278.

The top portion 272 further includes a first elongated projection 304, a second elongated projection 306, and a third elongated projection 308. The first elongated projection 304 is disposed between the first centerline 291 and the second exterior edge 290. The first elongated projection 204 may be disposed opposite the V-shaped projection 292 with respect to the first centerline 291. More particularly, the first elongated projection 304 is disposed opposite the second leg 296 of the V-shaped projection 292 with respect to the first centerline 291. In various implementations, the first elongated projection 304 is substantially a mirror image of at least a portion of the V-shaped projection 292 (for example, the second leg 296) about the first centerline 291.

The second elongated projection 306 is disposed between the first centerline 291 and the first exterior edge 288. The second elongated projection 306 is spaced apart from the V-shaped projection 292 along the first centerline 291. Thus, the second elongated projection 306 is disposed between the second leg 296 of the V-shaped projection 292 and the first distal point 286.

The third elongated projection 308 is disposed between the first centerline 291 and the second exterior edge 290. The third elongated projection 308 is spaced apart from the first elongated projection 304 along the first centerline 291. Thus, the third elongated projection 308 is disposed between the first elongated projection 304 and the first distal point 286. The third elongated projection 308 is disposed opposite the second elongated projection 306 with respect to the first centerline 291. In various implementations, the third elongated projection 308 is substantially a mirror image of at least a portion of the second elongated projection 306 about the first centerline 291.

Each of the first and second legs 294, 296 and the first, second, and third elongated projections 304, 306, 308 is oriented such that it is closest to the centerline 291 at a proximal end (that is, closest to the first proximal point 284) and furthest from the centerline 291 at a distal end (that is, closest to the first distal point 286). In various implementations, the second leg 296 and the first, second, and third elongated projections 304, 306, 308 are substantially straight. In various other implementations, the second leg 296 and the elongated projections 304, 306, 308 have curvature. For example, such curvature may complement a shape of the foodstuffs, such as a perimeter of a bun crown.

When the box 270 is in the open position, the projections 292, 304, 306, 308 cooperate to guide foodstuffs into the top portion 272. In one example, the crown of the burger bun is dropped into the top portion 272 upside down. As the crown falls in the downward direction 25 (FIG. 1), it approaches the box 270 with its inside surface facing the top portion 272 of the box 270 and its outside surface facing the bottom portion 274 of the box 270. The outside surface of the bun crown contacts the first leg 294 of the V-shaped projection 292, which acts as a rail, and slides into position. By sliding on the V-shaped projection 292 rather than the first inner surface 280, surface area contact between the bun crown and the box 270 is minimized, thereby minimizing friction between the bun crown and box 270 and easing the loading of the crown into the top portion 272 of the box 270. Furthermore, the peak 298 of the V-shaped projection 292 acts as a pivot point for the bun crown to ensure that it falls into the correct orientation within the top portion 272 of the box 270 and does not land upside down. After sliding down the V-shaped projection 292, the bun crown lands in a cradle 310 that is at least partially defined by the second leg 296 of the V-shaped projection 292, and the first, second, and third elongated projections 304, 306, 308.

The interaction between the bun crown and the projections 292, 304, 306, 308 facilitates maintaining the bun crown in a top-surface-upward orientation. The curvature of the first inner surface 280 complements the curvature of the outer surface of the bun crown in the cradle 310. The bun crown is retained in the cradle 310 while its inner surface disposed substantially parallel to a surface 312 (FIG. 7) upon which the box 270 is supported, such as the conveyor surface 26 of the conveyance system 16.

When the box 270 is in the closed position, the curvature of the top portion 272 can cooperate with the projections 292, 304, 306, 308 to give the box 270 an aesthetically-pleasing appearance. For example, an outer surface 314 (FIG. 7), the first perimeter 282, and the projections 292, 304, 306, 308 may generally give the box 270 the appearance of a leaf.

The bottom portion 274 includes a floor 320 and a peripheral wall 322 that are connected along an interior edge 324. The peripheral wall 322 is angled upwardly and outwardly from the floor 320. The floor 320 is planar and therefore configured to engage a planar surface, such as the surface 312 or the conveyor surface 26 of the conveyance system 16 (FIG. 1). A second inner surface 326 of the bottom portion 274 of the box 270 extends across the floor 320 and the peripheral wall 322.

The bottom portion 274 includes a second perimeter 328. The second perimeter 328 may define a substantially elliptical shape having pointed ends. Accordingly, the second perimeter 328 may be substantially lens shaped.

The second perimeter 328 includes a second proximal point 330, a second distal point 332, a third exterior edge 334, and a fourth exterior edge 336. The second proximal point 330 may be disposed adjacent to the joint 276 and the second distal point 332 may be disposed opposite the joint 276. The third exterior edge 334 extends between the second proximal point 330 and the second distal point 332, at least partially along the joint 276. The fourth exterior edge 336 extends between the second proximal point 330 and the second distal point 332, opposite the second proximal edge. A second centerline 338 extends across the shortest distance between the second proximal point 330 and the second distal point 332. The third exterior edge 334 and the fourth exterior edge 336 are both convex with respect to the second centerline 338.

The floor 320 defines a stage 340. The stage 340 projects inward from the second inner surface 326 into the compartment 278 when the box 270 is in the closed position. Thus, the stage 340 is concave with respect to the compartment 278. The stage 340 is spaced apart from the peripheral wall 322 so that an outer channel 342 extends around a perimeter 344 of the stage 340. The stage 340 includes a first portion 346 and a second portion 348 separated by an inner channel 350. The stage perimeter 344 complements the curvature of the interior edge 324 so that the outer channel 342 is substantially the same width around the entire perimeter 344. The channels 342, 350 are at least partially defined by the stage 340 and the peripheral wall 322. The first portion 346 defines a first contact surface 352 and the second portion 348 defines a second contact surface 354.

The first and second contact surfaces 352, 354 cooperate to define a planar contact surface onto which foodstuffs can be disposed. For example the bun heel may be disposed on the stage 340. The planar contact surface can support the bun heel while other ingredients are placed onto the bun heel. Excess ingredients, such as sauce, can collect in the outer and inner channels 342, 350, away from the bun heel, to prevent the bun heel from absorbing liquids.

The box 270 includes features that are configured to cooperate with features on a second box 270' to maintain separation between boxes when they are stacked in the nest 92. Features that are unique to the second box 270' are shown in dashed lines. Unless otherwise described, the second box 270' is identical to the box 270.

Four protrusions 356 are disposed about the interior edge 324 and spaced apart from one another on the box 270. The protrusions 356 cooperate with identical offset protrusions 356' on the second box 270'. The boxes 270, 270' are alternatingly disposed within the stack of boxes. Thus, a gap is maintained between boxes 270, 270' on the stack. Similarly, the indent 302 on the top portion 272 of the box 270 cooperates with an identical offset indent 302' on the second box 270'. The boxes 270, 270' may alternatively be randomly disposed within the stack. In various other implementations, a stack of boxes may include greater than two variations that are alternatingly or randomly disposed within the stack, such as three variations, four variations, five variations, or six variations, by way of example.

The box 270 further includes a locking feature to maintain the box 270 in the closed position. An example locking feature includes a slot 358 and a tab 360. The slot 358 is disposed on the bottom portion 274 of the box 270. The slot 358 is disposed adjacent to the fourth exterior edge 336. The tab 360 is disposed on the top portion 272 of the box 270. The tab 360 projects from the second exterior edge 290. When the box 270 is in the closed position, the tab 360 is received in the slot 358 to maintain the box 270 in the closed position.

As best shown in FIG. 7, the bottom portion 274 of the box 270 includes a non-uniform height with respect to the surface 312. More particularly, a first height 370 of the bottom portion 274 at the second proximal point 330 is greater than a second height 372 of the bottom portion 274 at the second distal point 332. The first and second heights 370, 372 may be measured substantially perpendicular to the surface 312. The third exterior edge 334 may slope or curve downward from the second proximal point 330 to the second distal point 332. The profile of the third exterior edge 334 may facilitate providing structure sufficient to contain the foodstuffs, while providing visibility of the foodstuffs. In various implementations, the box 270 may include a substantially smooth outer surface 378 to facilitate reliable gripping by the suction grippers 246.

As described above, both of the top and bottom portions 272, 274 of the box 270 may contain foodstuffs. The foodstuffs are at least partially retained by features of the box 270, such as the walls 279, 322 and the projections 292, 304, 306, 308. The box 270 can therefore be closed by concurrently pivoting the top portion 272 toward the bottom portion 274 as indicated by the arrow 374, and pivoting the bottom portion 274 toward the top portion 272, as indicated by the arrow 376. For example, the portions 272, 274 may be pivoted about 90° toward one another to close the box 270. Closing the box 270 in the manner described above allows the box 270 to be closed without a human operator touching the foodstuffs contained therein. Furthermore, the human operator may close the box 270 using one hand.

In various implementations, the present disclosure provides an example method of dispensing a box onto a surface. The method is described in the context of the box-dispensing apparatus 12, the box 14, and the conveyor surface 26 of FIG. 1. One skilled in the art will appreciate that the method could be performed with another box-dispensing apparatus, box, and or surface (not shown). The method may be performed by a control module, which may include multiple submodules, not shown or described herein.

Figure 8:
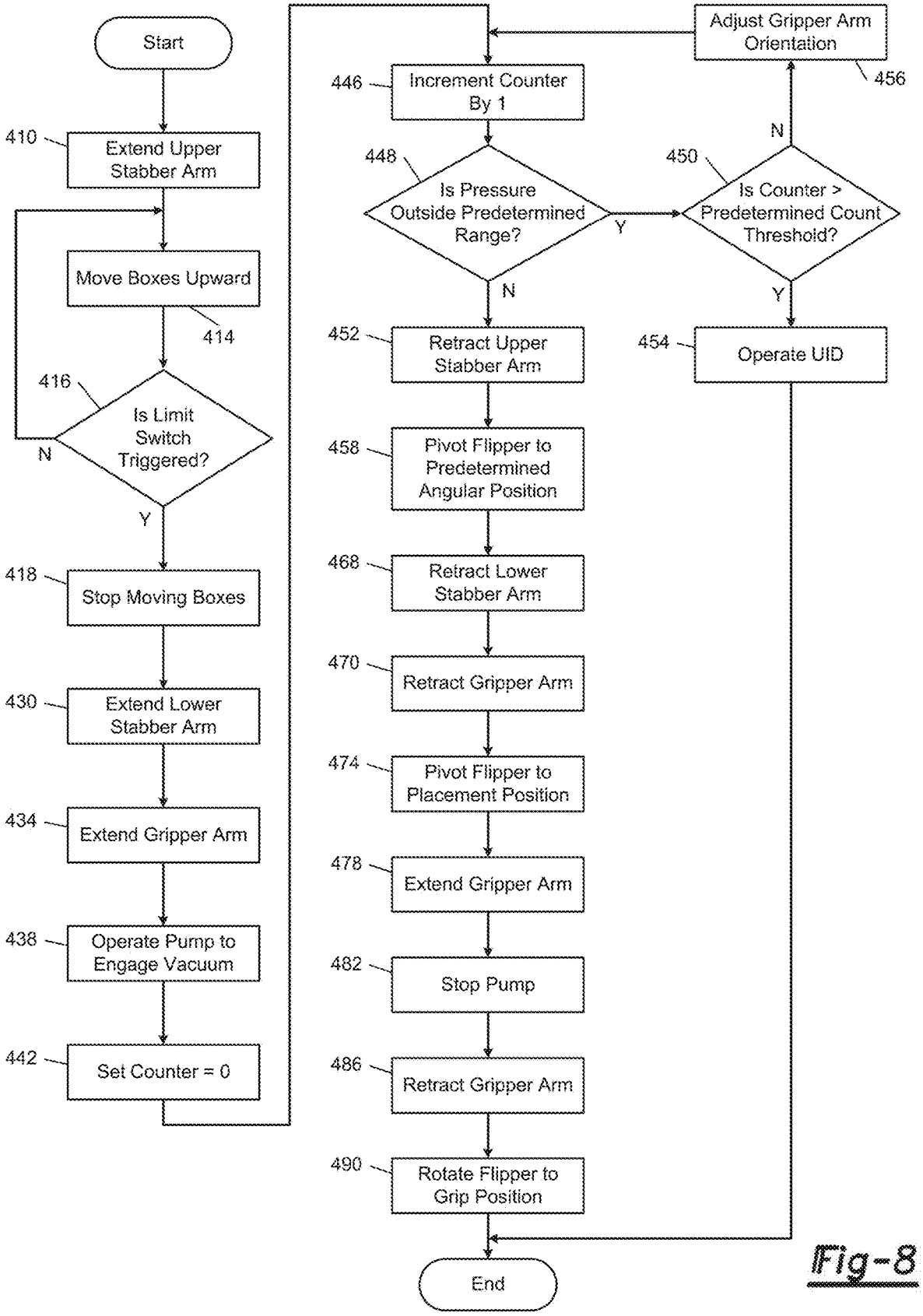
FIG. 8 is a flowchart of an example method of dispensing a box from the box-dispensing apparatus of FIG. 2 according to certain aspects of the present disclosure.

In FIG. 8, control begins at 410 where control extends the stabber arms 134, 136 to prepare for engagement with the box 14. Control operates the first linear actuator 152 to translate the upper stabber arm 134 along the upper stabber axis 180 in the third direction 184 from the first retracted position to the first extended position. The method continues at 414.

At 414, control moves the stack of boxes in the upward direction 27 to engage the upper stabber arm 134. Control operates the linear actuator 82 to translate the platform subassembly 80 in the upward direction 27. The stack of boxes translates together with the platform subassembly 80. As the platform subassembly 80 translates in the upward direction 27, the box 14 engages the upper stabber arm 134. As the platform subassembly 80 continues to translate in the upward direction 27, the engagement of the box 14 with upper stabber arm 134 causes the pivotable body 132 to rotate in the first rotational direction 144 about the first rotational axis 142. The method continues at 416.

At 416, control determines whether the third limit switch is triggered. The third limit switch is triggered when the separator subassembly 30 has been rotated into the second separator position. If the third limit switch is triggered, the method continues at 418; otherwise, the method returns to 414.

At 418, control stops moving the stack of boxes in the upward direction 27. Specifically, control stops operating the linear actuator 82 in the upward direction 27 via the first motor 84. The method continues at 430.

At 430, control operates the second linear actuator 154 via the second motor 156 to translate the lower stabber arm 136 along the lower stabber axis 182 in the third direction 184 from the second retracted position to the second extended position. In the second extended position, the lower stabber arm 136 engages a second-from-the-top box. The second-from-the-top box is disposed adjacent to and immediately below the top box 14. The lower stabber arm 136 engages the second-from-the-top box at a joint between top and bottom portions of the second-from-the-top box (similar to the joint 276 of the box 270). The box 14 may therefore be disposed between the upper and lower stabber arms 134, 136. The upper stabber arm 134 may prevent translation of the box 14 in the second direction 27. The lower stabber arm 136 may prevent translation of the box 14 in the first direction 25. The method continues at 434.

At 434, control extends the gripper arm 214 to engage the box 14. Control operates the fourth linear actuator 244 to translate the gripper arm 214 along the gripper axis 242 from the third retracted position to the third extended position. In the third extended position, the suction grippers 246 are configured to engage the box 14. The method continues at 438.

At 438, control turns on the pump 34, and operates the pump 34 to pull air through the suction grippers 246 and the flexible tubes 254. The method continues at 442.

At 442, control sets a counter to zero (0). The method continues at 446.

At 446, control increments the counter by one (1). The method continues at 448.

At 448, control determines whether the vacuum pressure within the tubes 254 is outside of a predetermined range. A vacuum pressure that is outside of the predetermined range indicates that the suction grippers 246 are not properly engaged with the box 14. If the vacuum pressure is outside of the predetermined range, the method continues at 450; otherwise, the method continues at 452.

At 450, control determines whether the counter exceeds a predetermined count threshold. If the counter exceeds the predetermined count threshold, the method continues at 454; otherwise, the method continues at 456.

At 454, control operates a user interface device (UID) to alert an operator of a potential gripping malfunction. The UID may include a visual display (such as, scrolling text or a flashing light), an audible display (such as, an alarm), and/or tactile feedback (such as, a vibration on a wristband). The method then ends.

At 456, control adjusts an orientation the gripper arm 214 to attempt to engage the box 14. Control may adjust the gripper arm 214 by one or more of (i) pivoting the intermediate portions 234 of the gripper arm 214 about the first pivot axes 238; (ii) pivoting the outer portions 236 of the gripper arm 214 about the second pivot axes 240; (iii) translating the gripper arm 214 along the gripper axis 242; and (iv) translating the platform subassembly 80 to adjust a height of the box 14. The method continues at 446.

At 452, the vacuum pressure is within the predetermined range and control retracts the upper stabber arm 134 to provide clearance for the gripper subassembly 32 to pivot the box 14 from the grip position to the placement position. Specifically, control operates the first linear actuator 152 to translate the upper stabber arm 134 along the upper stabber axis 180 from the first extended position to the first retracted position. The method continues at 458.

At 458, control de-nests the box 14 from the stack and pivots the box 14 away from the grip position. Control operates the third motor 216 to rotate the flipper 212 about the second rotational axis 222 from the grip position to a predetermined angular position. The predetermined angular position is between the grip position and the placement position. The method continues at 468.

At 468, control retracts the lower stabber arm 136. More particularly, control operates the first linear actuator 152 to translate the lower stabber arm 136 along the lower stabber axis 182 in the fourth direction 186 from the second extended position to the second retracted position. In other implementations, control may retract the lower stabber arm 136 at 468 concurrently with pivoting the box 14 at 454. Alternatively, control may retract the lower stabber arm 136 any time before the method restarts at 410. The method continues at 470.

At 470, control retracts the gripper arm 214 so that the box 14 clears other components of the automated food preparation system 10 during rotation of the flipper 212. Control operates the linear actuator 244 to translate the gripper arm 214 along the gripper axis 242 from the third extended position to the third retracted position. The method continues at 474.

At 474, control pivots the flipper 212 toward the placement position. Control operates the third motor 216 to rotate the flipper 212 about the second rotational axis 222 from the predetermined angular position to the placement position. The method continues at 478.

At 478, control extends the gripper arm 214 to prepare to release the box 14. Control operates the linear actuator 244 to translate the gripper arm 214 along the gripper axis 242 from the third retracted position to the third extended position. In various aspects, 470 and 478 may be omitted from the method, such as when the gripper arm 214 does not need to clear components along its path between the grip and placement positions. The method continues at 482.

At 482, control releases the vacuum pressure by operating the pump 34 to stop the flow of air. The box 14 disengages from the suction grippers 246 and is deposited on the conveyor surface 26 of the conveyance system 16. The method continues at 486.

At 486, control retracts the gripper arm 214. Control operates the fourth linear actuator 244 to translate the gripper arm 214 along the gripper axis 242 from the third extended position to the third retracted position. The method continues at 490.

At 490, control pivots the flipper 212 to the grip position to prepare to restart the method. Control operates the third motor 216 to rotate the flipper 212 about the second rotational axis 222 from the placement position, through the predetermined angular position, and to the grip position. The method ends.

Figure 9:
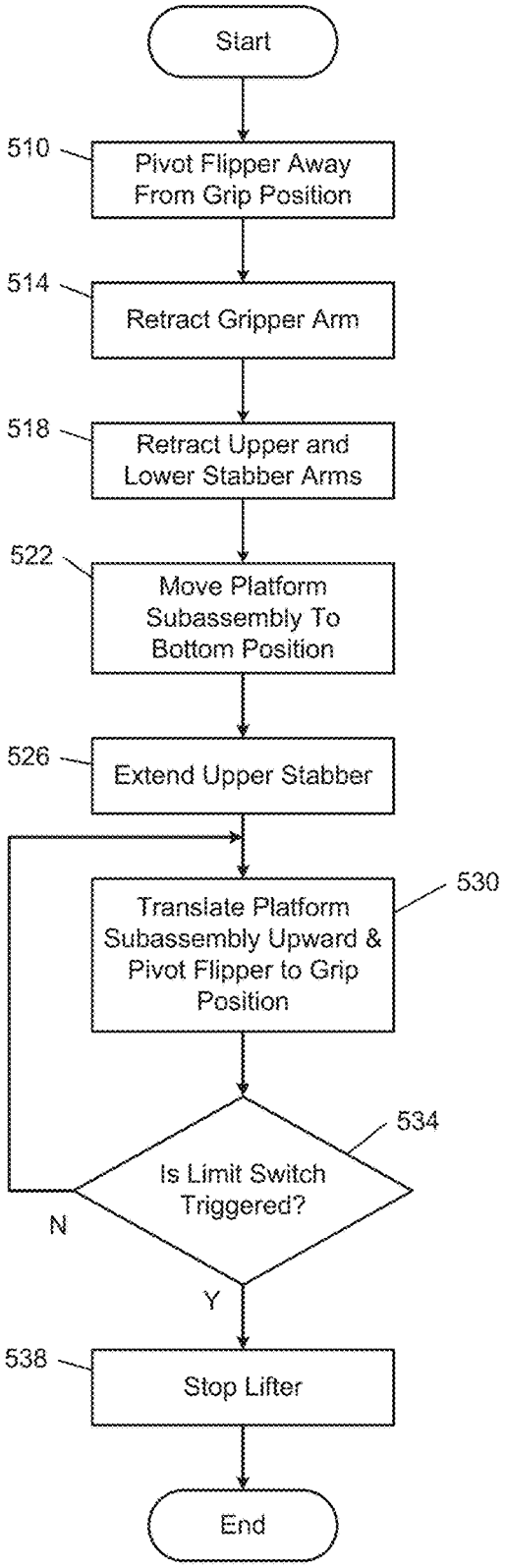
FIG. 9 is a flowchart of an example method of homing the box-dispensing apparatus of FIG. 2 according to certain aspects of the present disclosure.

In various implementations, the present disclosure provides a method of homing the box-dispensing apparatus 12. In FIG. 9, the method begins at 510, where control operates the third motor 216 to pivot the flipper 212 away from the grip position. The method continues at 514. At 514, control operates the fourth linear actuator 244 to translate the gripper arm 214 from the third extended position to the third retracted position. The method continues at 518.

At 518, control operates the first and second linear actuators 152, 154 to retract the upper and lower stabber arms 134, 136. Specifically, control operates the first linear actuator 152 to move the upper stabber arm 134 from the first extended position to the first retracted position. Control operates the second linear actuator 154 to move the lower stabber arm 136 from the second extended position to the second retracted position. The method continues at 522.

At 522, control operates the linear actuator 82 to translate the platform subassembly 80 to the bottom position. The method continues at 526. At 526, control operates the first linear actuator 152 to translate the upper stabber arm 134 from the first retracted position to the first extended position. The method continues at 530.

At 530, control operates the linear actuator 82 to translate the platform subassembly 80 in the upward direction 27. Concurrently, control operates the third motor 216 to pivot the flipper 212 to the grip position. In various other implementations, control pivots the flipper 212 before or after translating the platform subassembly 80 in the upward direction 27, rather than concurrently. The method continues at 534.

At 534, control determines whether the limit switch is triggered. If the limit switch is triggered, the method continues at 538; otherwise, the method returns to 530. At 538, control ceases operation of the linear actuator 82 to stop translation of the platform subassembly 80. The method ends.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. It should be understood that one or more steps within a method may be executed in different order (or concurrently) without altering the principles of the present disclosure. Further, although each of the embodiments is described above as having certain features, any one or more of those features described with respect to any embodiment of the disclosure can be implemented in and/or combined with features of any of the other embodiments, even if that combination is not explicitly described. In other words, the described embodiments are not mutually exclusive, and permutations of one or more embodiments with one another remain within the scope of this disclosure.

Spatial and functional relationships between elements (for example, between modules, circuit elements, semiconductor layers, etc.) are described using various terms, including "connected," "engaged," "coupled," "adjacent," "next to," "on top of," "above," "below," and "disposed." Unless explicitly described as being "direct," when a relationship between first and second elements is described in the above disclosure, that relationship can be a direct relationship where no other intervening elements are present between the first and second elements, but can also be an indirect relationship where one or more intervening elements are present (either spatially or functionally) between the first and second elements.

As used herein, the phrase at least one of A, B, and C should be construed to mean a logical (A OR B OR C), using a non-exclusive logical OR, and should not be construed to mean "at least one of A, at least one of B, and at least one of C." The term subset does not necessarily require a proper subset. In other words, a first subset of a first set may be coextensive with (equal to) the first set.

In the figures, the direction of an arrow, as indicated by the arrowhead, generally demonstrates the flow of information (such as data or instructions) that is of interest to the illustration. For example, when element A and element B exchange a variety of information but information transmitted from element A to element B is relevant to the illustration, the arrow may point from element A to element B. This unidirectional arrow does not imply that no other information is transmitted from element B to element A. Further, for information sent from element A to element B, element B may send requests for, or receipt acknowledgements of, the information to element A.

In this application, including the definitions below, the term "module" or the term "controller" may be replaced with the term "circuit." The term "module" may refer to, be part of, or include: an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor circuit (shared, dedicated, or group) that executes code; a memory circuit (shared, dedicated, or group) that stores code executed by the processor circuit; other suitable hardware components that provide the described functionality; or a combination of some or all of the above, such as in a system-on-chip.

The module may include one or more interface circuits. In some examples, the interface circuit(s) may implement wired or wireless interfaces that connect to a local area network (LAN) or a wireless personal area network (WPAN). Examples of a LAN are Institute of Electrical and Electronics Engineers (IEEE) Standard 802.11-2016 (also known as the WIFI wireless networking standard) and IEEE Standard 802.3-2015 (also known as the ETHERNET wired networking standard). Examples of a WPAN are the BLUETOOTH wireless networking standard from the Bluetooth Special Interest Group and IEEE Standard 802.15.4.

The module may communicate with other modules using the interface circuit(s). Although the module may be depicted in the present disclosure as logically communicating directly with other modules, in various implementations the module may actually communicate via a communications system. The communications system includes physical and/or virtual networking equipment such as hubs, switches, routers, and gateways. In some implementations, the communications system connects to or traverses a wide area network (WAN) such as the Internet. For example, the communications system may include multiple LANs connected to each other over the Internet or point-to-point leased lines using technologies including Multiprotocol Label Switching (MPLS) and virtual private networks (VPNs).

In various implementations, the functionality of the module may be distributed among multiple modules that are connected via the communications system. For example, multiple modules may implement the same functionality distributed by a load balancing system. In a further example, the functionality of the module may be split between a server (also known as remote, or cloud) module and a client (or, user) module.

Some or all hardware features of a module may be defined using a language for hardware description, such as IEEE Standard 1364-2005 (commonly called "Verilog") and IEEE Standard 1076-2008 (commonly called "VHDL"). The hardware description language may be used to manufacture and/or program a hardware circuit. In some implementations, some or all features of a module may be defined by a language, such as IEEE 1666-2005 (commonly called "SystemC"), that encompasses both code, as described below, and hardware description.

The term code, as used above, may include software, firmware, and/or microcode, and may refer to programs, routines, functions, classes, data structures, and/or objects. The term shared processor circuit encompasses a single processor circuit that executes some or all code from multiple modules. The term group processor circuit encompasses a processor circuit that, in combination with additional processor circuits, executes some or all code from one or more modules. References to multiple processor circuits encompass multiple processor circuits on discrete dies, multiple processor circuits on a single die, multiple cores of a single processor circuit, multiple threads of a single processor circuit, or a combination of the above. The term shared memory circuit encompasses a single memory circuit that stores some or all code from multiple modules. The term group memory circuit encompasses a memory circuit that, in combination with additional memories, stores some or all code from one or more modules.

The term memory circuit is a subset of the term computer-readable medium. The term computer-readable medium, as used herein, does not encompass transitory electrical or electromagnetic signals propagating through a medium (such as on a carrier wave); the term computer-readable medium may therefore be considered tangible and non-transitory. Non-limiting examples of a non-transitory computer-readable medium are nonvolatile memory circuits (such as a flash memory circuit, an erasable programmable read-only memory circuit, or a mask read-only memory circuit), volatile memory circuits (such as a static random access memory circuit or a dynamic random access memory circuit), magnetic storage media (such as an analog or digital magnetic tape or a hard disk drive), and optical storage media (such as a CD, a DVD, or a Blu-ray Disc).

The apparatuses and methods described in this application may be partially or fully implemented by a special purpose computer created by configuring a general purpose computer to execute one or more particular functions embodied in computer programs. The functional blocks and flowchart elements described above serve as software specifications, which can be translated into the computer programs by the routine work of a skilled technician or programmer.

The computer programs include processor-executable instructions that are stored on at least one non-transitory computer-readable medium. The computer programs may also include or rely on stored data. The computer programs may encompass a basic input/output system (BIOS) that interacts with hardware of the special purpose computer, device drivers that interact with particular devices of the special purpose computer, one or more operating systems, user applications, background services, background applications, etc.

The computer programs may include: (i) descriptive text to be parsed, such as HTML (hypertext markup language), XML (extensible markup language), or JSON (JavaScript Object Notation), (ii) assembly code, (iii) object code generated from source code by a compiler, (iv) source code for execution by an interpreter, (v) source code for compilation and execution by a just-in-time compiler, etc. As examples only, source code may be written using syntax from languages including C, C++, C #, Objective-C, Swift, Haskell, Go, SQL, R, Lisp, Java®, Fortran, Perl, Pascal, Curl, OCaml, Javascript®, HTML5 (Hypertext Markup Language 5th revision), Ada, ASP (Active Server Pages), PHP (PHP: Hypertext Preprocessor), Scala, Eiffel, Smalltalk, Erlang, Ruby, Flash®, Visual Basic®, Lua, MATLAB, SIMULINK, and Python®.

The invention claimed is:

1. An apparatus for dispensing a single box for containing foodstuffs, the apparatus comprising:

a housing at least partially defining an inner area;

a lift subassembly coupled to the housing and disposed at least partially within the inner area, wherein the lift subassembly includes a nest configured to support a plurality of boxes disposed in a stack and to translate with respect to the housing in a first direction and a second direction opposite the first direction;

a transfer subassembly coupled to the housing and disposed at least partially within the inner area, wherein the transfer subassembly includes a vacuum suction cup configured to operatively engage a first box of the plurality of boxes to remove the first box from the stack and pivot the first box about a rotational axis to a surface outside of the inner area; and a separator subassembly coupled to the housing, wherein:

the separator subassembly includes a first arm and a second arm, the first arm is configured to translate with respect to the housing between a first retracted position and a first extended position independent of the second arm and to prevent translation of the first box in the second direction, the second arm is configured to translate with respect to the housing between a second retracted position and a second extended position independent of the first arm and to prevent translation of the first box in the first direction, and the first arm in the first extended position is configured to cooperate with the second arm in the second extended position to retain the first box between the first arm and the second arm.

2. The apparatus of claim 1 wherein the second arm in the second extended position is configured to engage a second box to retain the second box on the stack while the transfer subassembly removes the first box from the stack.

3. The apparatus of claim 2, wherein the second arm is configured to engage the second box at a joint between a first box portion and a second box portion.

4. The apparatus of claim 1 wherein the first arm and the second arm are pivotable with respect to the housing between a first separator position and a second separator position.

5. The apparatus of claim 4 wherein:

the first arm and the second arm are disposed in the second direction with respect to the stack;

the first arm and the second arm are configured to pivot from the first separator position to the second separator position via engagement with the first box when the lift subassembly translates the stack in the second direction; and the first arm and the second arm are configured to automatically return to the first separator position from the second separator position upon disengagement with the first box when the lift subassembly translates the stack in the first direction.

6. The apparatus of claim 4, wherein:

the first arm and the second arm are pivotable from the first separator position to the second separator position in a rotational direction; and the separator subassembly further includes a limit switch configured to prevent the first arm and the second arm from pivoting past the second separator position in the rotational direction.

7. The apparatus of claim 1 wherein the vacuum suction cup is configured to translate between a retracted position and an extended position with respect to the housing.

8. The apparatus of claim 1 wherein the vacuum suction cup is configured to pivot about at least one of a first pivot axis substantially parallel to the rotational axis and a second pivot axis substantially perpendicular to the rotational axis.

9. The apparatus of claim 1 wherein the transfer subassembly further includes an optical sensor configured to pivot about the rotational axis together with the vacuum suction cup.

10. The apparatus of claim 1 wherein the vacuum suction cup includes:

a first vacuum suction cup configured to operatively engage a first portion of the first box; and a second vacuum suction cup configured to operatively engage a second portion of the first box.

11. The apparatus of claim 10 wherein:

the first vacuum suction cup and the second vacuum suction cup are configured to pivot together about the rotational axis;

the first vacuum suction cup and the second vacuum suction cup are configured to translate together between a retracted position and an extended position; and the first vacuum suction cup and the second vacuum suction cup are configured to independently pivot about respective first pivot axes substantially parallel to the rotational axis and respective second pivot axes substantially perpendicular to the rotational axis.

12. The apparatus of claim 1 wherein:

the transfer subassembly is configured to pivot the first box through an angle about 180° about the rotational axis between a grip position and a placement position; and the first box has an open side disposed toward the first direction in the grip position and the second direction in the placement position.

13. The apparatus of claim 1 wherein:

the lift subassembly further includes a plurality of posts extending substantially parallel to the first direction and the second direction;

the nest is disposed within a perimeter at least partially defined by the plurality of posts; and the plurality of posts is configured to cooperate with the nest to retain the stack within the inner area.

14. The apparatus of claim 1, wherein the second arm includes a tapered distal end.

15. A box for containing foodstuffs, the box comprising:

a first portion including a curved wall having a first perimeter, wherein:

the first perimeter includes a first edge, a second edge, and a centerline extending between the first edge and the second edge, the curved wall defines a substantially V-shaped projection, a first elongated projection, a second elongated projection, and a third elongated projection, the V-shaped projection is disposed between the first edge and the centerline, the V-shaped projection includes a first leg, a second leg, and a peak connecting the first leg and the second leg, the first leg extends from the peak to an intersection of the centerline and the first edge, the second leg extends from the peak to an intermediate point adjacent to the first edge, the first elongated projection is disposed between the centerline and the second edge and opposite the V-shaped projection with respect to the centerline, the second elongated projection is disposed between the first edge and the centerline and spaced apart from the V-shaped projection along the centerline, the third elongated projection is disposed between the second edge and the centerline, spaced apart from the first elongated projection along the centerline, and opposite the second elongated projection with respect to the centerline, the second leg, the first elongated projection, the second elongated projection, and the third elongated projection cooperate to define a cradle, and the cradle is configured to receive at least a portion of the foodstuffs;

a second portion including a floor and a peripheral wall surrounding and extending from the floor, the peripheral wall having a second perimeter, at least a portion of the floor being substantially planar; and a joint pivotally connecting the curved wall of the first portion and the peripheral wall of the second portion such that the box is movable between a closed position and an open position, wherein:

the first portion and the second portion cooperate to define a compartment in the closed position, the curved wall is convex with respect to the compartment, and the substantially V-shaped projection, the first elongated projection, the second elongated projection, and the third elongated projection are concave with respect to the compartment.

16. The box of claim 15 wherein the first perimeter and the second perimeter are substantially lens shaped.

17. The box of claim 15 wherein the peripheral wall defines a first height adjacent to the joint and a second height opposite the joint, the first height being greater than the second height.

18. The box of claim 15 wherein the floor includes a stage and a channel, the stage projecting into the compartment and being configured to support foodstuffs, and the channel being at least partially defined by the stage and the peripheral wall.

19. A method of dispensing a box from an apparatus, the method comprising:

providing a plurality of boxes disposed in a stack within an inner area of a housing of the apparatus, wherein:

the apparatus includes the housing, a lift subassembly coupled to the housing, a transfer subassembly coupled to the housing, and a separator subassembly coupled to the housing, the lift subassembly includes a nest configured to translate in a first direction and a second direction opposite the first direction with respect to the housing, the nest is configured to be disposed in the first direction with respect to the stack and support the stack, and the separator subassembly includes a first arm and a second arm;

operating a first linear actuator to move the first arm from a first retracted position to a first extended position;

positioning a box of the plurality of boxes in a gripping position by operating the lift subassembly to translate the stack in the second direction;

operating a second linear actuator to move the second arm from a second retracted position to a second extended position, the box being disposed between the first arm and the second arm;

gripping the box by operating a pump to operatively engage a vacuum suction cup of the transfer subassembly with the box, wherein the transfer subassembly is coupled to the housing and disposed at least partially within the inner area;

operating the first linear actuator to move the first arm from the first extended position to the first retracted position;

operating the transfer subassembly to pivot the box about a rotational axis from the gripping position to a placement position outside of the inner area; and dispensing the box onto a surface by operating the pump to disengage the box from the vacuum suction cup.

* * * * *